US005992075A

United States Patent [19]

Ockenfuss et al.

[11] Patent Number: 5,992,075

[45] Date of Patent: Nov. 30, 1999

[54] REPEATING GUN HAVING AN AXIALLY GUIDED REPEATING UNIT

[75] Inventors: Ulrich Ockenfuss, Baiersbronn; Dieter Keppeler, Fichtenberg, both of Germany

[73] Assignee: Sommer & Ockenfuss GmbH, Baiersbronn, Germany

[21] Appl. No.: 09/135,263

[22] Filed: Aug. 17, 1998

[30] Foreign Application Priority Data

Aug. 18, 1997 [DE] Germany ..... 197 35 737

[51] Int. Cl.[6] ..... F41A 17/46

[52] U.S. Cl. ..... 42/70.06; 89/190

[58] Field of Search ..... 42/70.06, 70.07; 89/181, 189, 190, 1.4

[56] References Cited

U.S. PATENT DOCUMENTS

| | | | |
|---|---|---|---|
| 1,085,698 | 2/1914 | Nelson | 42/70.06 |
| 1,593,981 | 7/1926 | McCvudden | 42/70.06 |
| 2,967,367 | 1/1961 | Ivy | 42/70.06 |
| 2,978,826 | 4/1961 | Ivy | 42/70.06 |
| 3,964,200 | 6/1976 | Patterson | 42/70.06 |
| 4,926,575 | 5/1990 | Pastor | 42/70.06 |

FOREIGN PATENT DOCUMENTS

| | | | |
|---|---|---|---|
| 106939 | 7/1896 | Germany . | |
| 410390 | 4/1945 | Italy | 42/70.06 |
| 466645 | 11/1951 | Italy | 42/70.06 |

OTHER PUBLICATIONS

Marchant Smith C.J. et al. "Small Arms & Cannons", Brassey's Publishers Limited, pp. 165–167, Aug. 4, 1983.

*Primary Examiner*—Stephen M. Johnson
*Attorney, Agent, or Firm*—Darby & Darby

[57] ABSTRACT

Repeating gun having an actuating arrangement which is mounted so as to be axially displaceable and which can be connected to a movable breech mechanism, which is guided likewise in an axial manner, for opening and closing the cartridge chamber, and can be locked by way of safety means, wherein the actuating arrangement is formed as an axially movable pistol grip (2) having a trigger guard (6), which frames a stationarily mounted trigger (5), and is connected to the breech mechanism (1) by way of two guide bars which are formed as L-shaped strips (3) and which slide in grooves on both sides of the axis of the barrel and are anchored with their shorter ends on the breech mechanism (1) as well as with their longer ends on the pistol grip (2) or the trigger guard (6) respectively, and in that the safety means comprise a spring-loaded press button (7) which is provided on the rear projection of the pistol grip (2) and by way of which the repeating unit is locked in the closed position of the breech mechanism and in the actuated state of the press button the safety of the trigger (5) is released.

4 Claims, 3 Drawing Sheets

REPEATING GUN HAVING AN AXIALLY GUIDED REPEATING UNIT

BACKGROUND OF THE INVENTION

1. Field of the Invention

The invention relates to a repeating gun having a repeating unit which is axially guided in a rail for opening and closing the cartridge chamber.

Many known axially guided repeating units are operated by means of a bolt handle which is secured to the breech mechanism. In this case, numerous hand movements are required in order to unlock and lock the breech mechanism. The shooting hand (usually the right hand) must be directed upwards to the bolt handle. This impedes rapid repeat cycling. In addition, the stable contact with the shoulder is disturbed, this impairing the shooting rhythm and, for example, forcing the hunter to pick up the target repeatedly when firing several shots at running game.

Furthermore, so-called pump action systems are known, in which the breech mechanism is controlled by moving the front stock or fore-end backwards and forwards. These systems have the disadvantage that when shooting from fixed gun rests (for example, raised-hides) repeat cycling is impossible without raising the weapon.

In the case of the so-called lever action repeating systems which are also known, repetition is effected by moving the trigger guard, extended towards the rear, up and down.

Furthermore, manual repeating weapons are known, the repeating action of which is controlled by a movable pistol grip on the small of the stock by slewing in the vertical line of the weapon. The disadvantage of this is that the support triangle that is required for safe shooting and which consists of the shoulder contact, elbow and hand on the fore-end is impaired as a result of the wrist movement.

2. Description of the Related Art

A repeating gun of the kind mentioned by way of introduction is known from the printed publication DE-A-195 30 793. Here, a repeating unit, consisting of the breech mechanism, the trigger group consisting of the trigger and trigger guard, and the pistol grip, is drawn back and pressed forwards axially. In this case, a telescopic piece runs into the hollow rear stock. The shooting hand remains on the pistol grip during the repeat cycling.

The disadvantage of this gun is that the trigger group, which has to be moved back as well, must be positioned in a very precise manner in order to release the shot, something which creates difficulties in terms of manufacturing engineering, and that, in the event of the weapon possibly becoming dirty or in the event of humidity-dependent swelling of the stock wood, the telescopic piece can become jammed. Moreover, in order to cancel the lock on the repeating unit, it is necessary to press a blocking lever downwards each time with the thumb, this being unfavourable ergonomically.

SUMMARY OF THE INVENTION

The object of the invention is to specify a gun of the described type, the repeating unit of which gun is less susceptible to faults and is easier to produce and operate.

This object is achieved in accordance with the invention in that in addition to the breech mechanism of the cartridge chamber, the pistol grip and the trigger guard, framing the trigger, form part of the repeating unit and in that strips connect the breech mechanism to the pistol grip and the trigger guard, which is secured thereto, to form the repeating unit. Reference is made to the subclaims with regard to features of preferred exemplary embodiments of the invention.

The invention will now be explained in greater detail with the aid of a preferred exemplary embodiment and with reference to the attached drawings.

DETAILED DESCRIPTION OF THE PRESENTLY PREFERRED EMBODIMENTS

Figure 1:
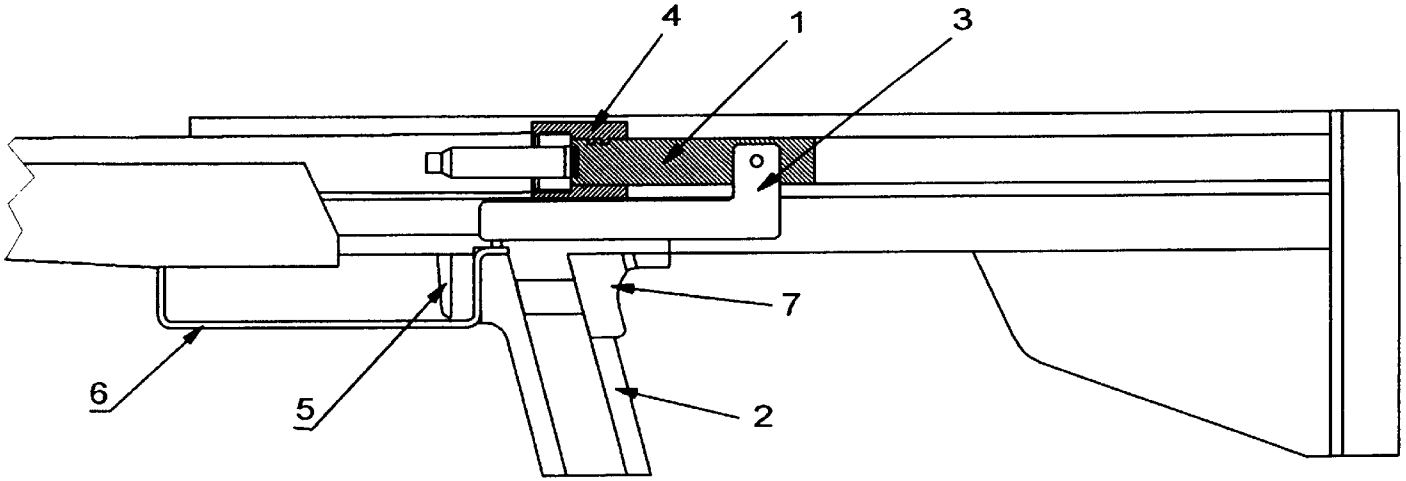
FIG. 1 diagrammatically shows a longitudinal section through a gun in accordance with the invention in the state in which the repeating unit is locked, just after shooting has taken place.
Figure 2:
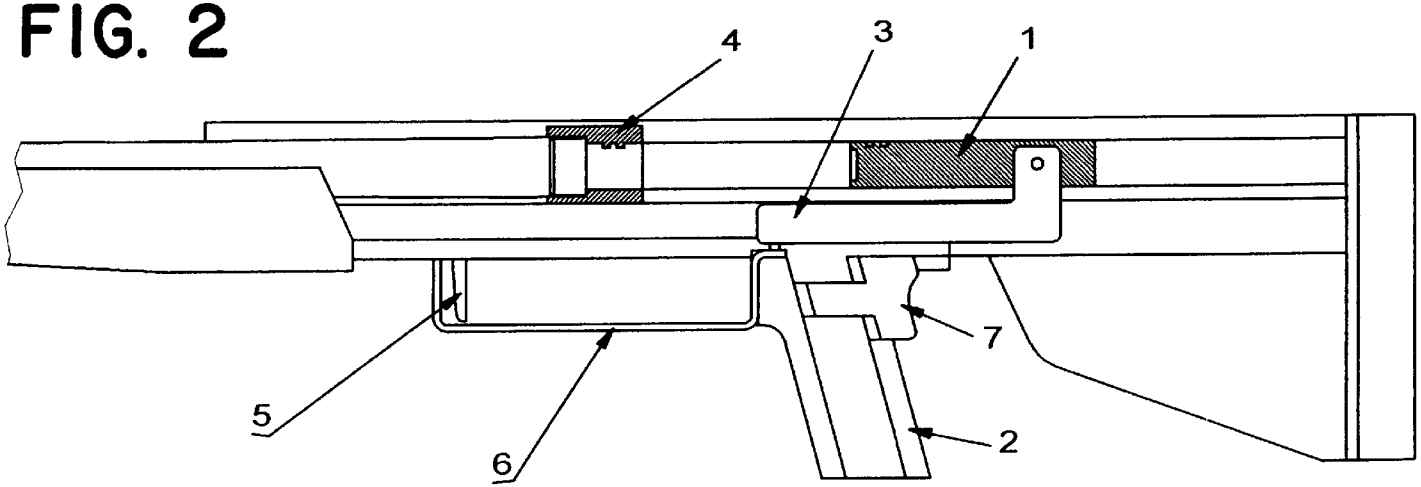
FIG. 2 shows a longitudinal section through the same gun with the breech mechanism fully opened after an empty cartridge has been ejected.

The general structure of the repeating gun in accordance with the invention will now be explained with reference to FIGS. 1 and 2. The gun, between the barrel (on the left in the figures) and the rear stock, has a repeating unit which can be axially displaced between the end positions shown in the two figures mentioned. The repeating unit consists of the breech mechanism 1, the pistol grip 2 and the trigger guard 6 mounted thereon. The pistol grip 2 and the trigger guard 6 are connected together with the breech mechanism 1 by way of two L-shaped strips 3 which are guided on both sides of the barrel axis in respective grooves. In the closed position (FIG. 1) the breech mechanism 1 penetrates into a breech-mechanism bearing 4, and a trigger 5 is located close to the pistol grip 2 so as to be easily accessible to the hand of the marksman clutching the pistol grip.

In the other end position (FIG. 2) the breech mechanism is drawn back and the chamber is opened. The trigger 5 is remote from the pistol grip inside the trigger guard 6 and is protected by the guard.

Arranged on the rear projection of the pistol grip 2 there is in addition a spring-loaded press button 7, the function of which will be explained further below with reference to FIGS. 3 to 6.

On account of its location on the rear projection of the pistol grip, the press button 7 is easily pressed towards the pistol grip 2 when the repeating unit is closed and is released when the unit is opened.

Figure 3:
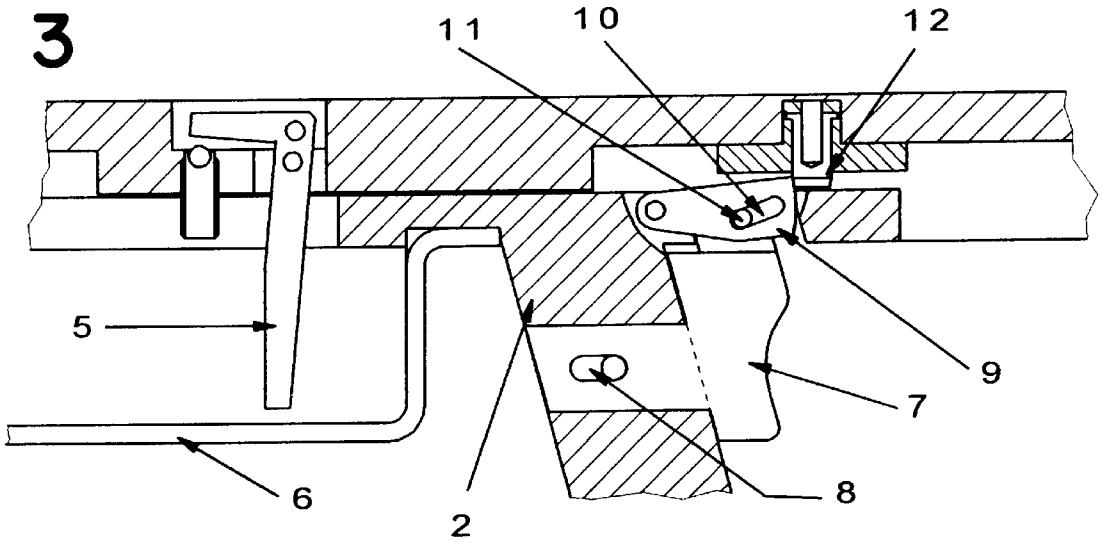
FIG. 3, on an enlarged scale and in a longitudinal section, shows the mechanism for locking the repeating unit in the blocking position.
Figure 4:
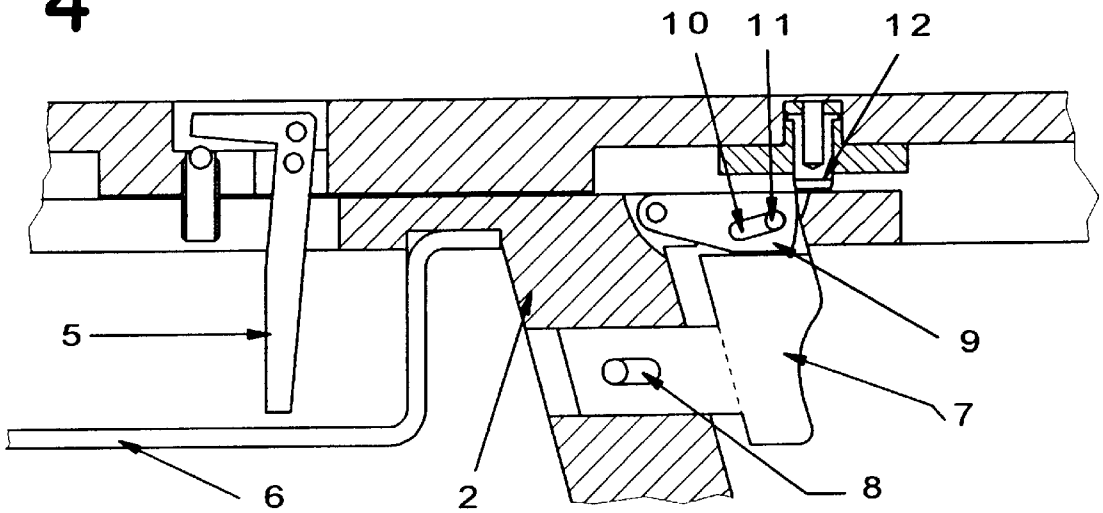
FIG. 4 shows the same mechanism in the unblocked position.

It can be seen in FIGS. 3 and 4 that the movement of the press button is directed through an elongated hole 8 in the pistol grip and is limited. The press button 7, for its part, carries a guide pin 11 which can be moved in an elongated hole 10 of a blocking catch 9 which is articulated on the pistol grip 2. This elongated hole 10 is shaped in such a way that when the press button 7 is pressed during the closing movement of the repeating unit the blocking catch 9 strikes against a spring-loaded blocking pin 12 and causes the latter to yield until the repeating unit has completely reached the closed end position. Only now is it possible for the blocking pin 12 to pass back into its rest position in which the blocking catch 9 is locked by the blocking pin. This position can be seen in FIG. 3.

If, on the other hand, the press button 7 is released and on account of its restoring spring (not shown) can pass back into its rest position (FIG. 4), the blocking catch 9 is freed again from the locking position so that the repeating unit can be drawn backwards.

Figure 5:
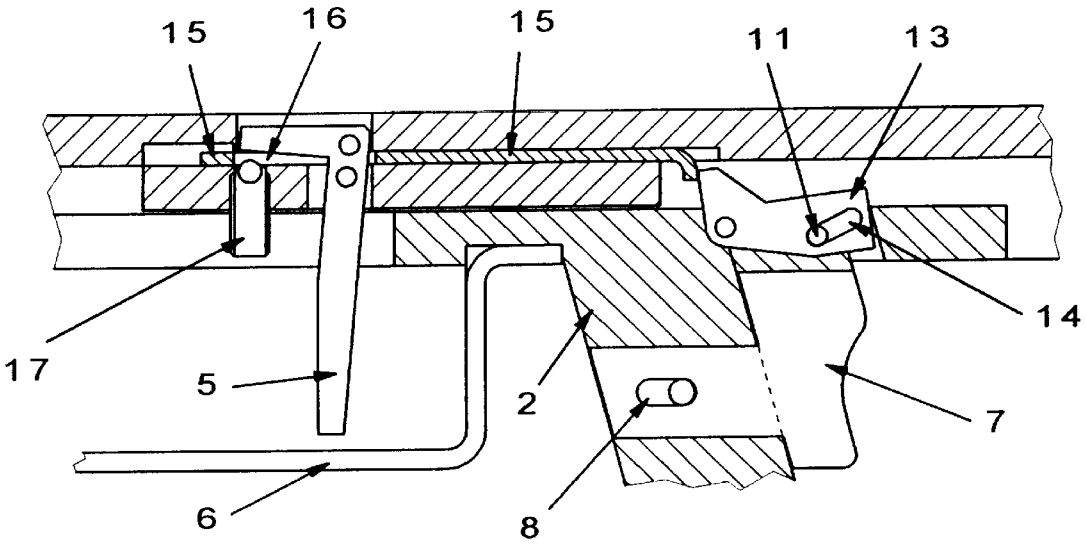
FIG. 5, in another longitudinal sectional representation, shows the mechanism for releasing the safety of the trigger in the position in which the safety has been released.
Figure 6:
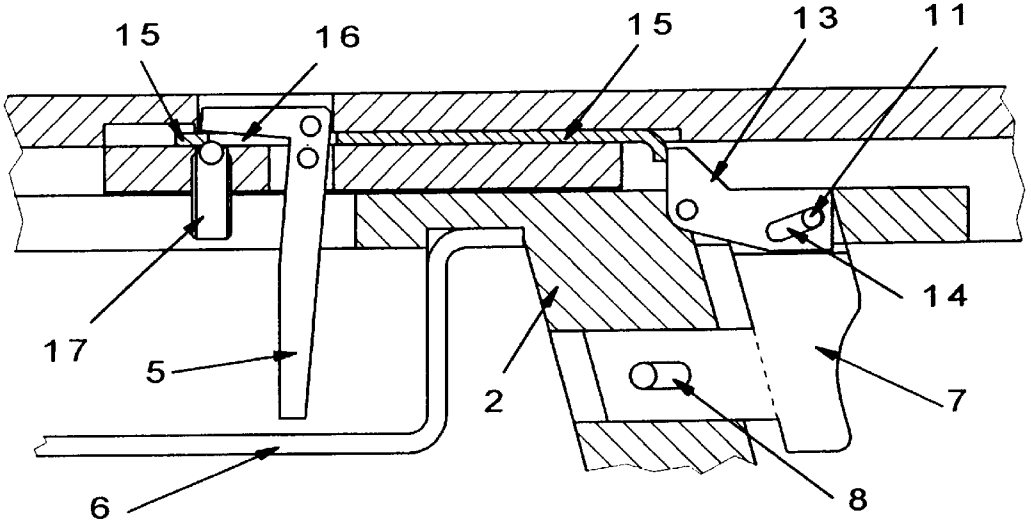
FIG. 6 shows the same detail in the safe position.

In FIGS. 5 and 6 a safety catch 13 can be seen that is controlled by the press button 7 likewise by way of the guide pin 11 which not only slides in the elongated hole 10 of the blocking catch 9, but also slides in an elongated hole 14 of the safety catch 13. This safety catch 13 is also articulated on the pistol grip and presses a safety plate 15 mounted in frame 18 against the force of a spring, which is not shown, into the position shown in FIG. 5 when the press button 7 is pressed down in the locked position of the repeating unit. In this case a window 16 in the safety plate 15 frees the trigger 5 so that the latter, in the event of actuation, can reach a trigger take-up screw 17. If, on the other hand, the press button is not pressed, the safety plate 15 is pushed as a result of the force of a restoring spring, which is not shown, between the trigger 5 and the trigger take-up screw 17 and prevents an unintentional shot.

The repeating unit operates as follows. In order to close the breech mechanism 1, the pistol grip 2 is pressed forwards and as a result of pressure on the press button the grip safety device is thereby activated by way of the blocking catch 9. After this catch, at the end of the movement of the repeating unit, has passed the blocking pin, the latter is pressed downwards by spring force so that the breech mechanism 1 is prevented from re-opening unintentionally. At the same time, the safety catch 13 tilts forwards so that the safety of the trigger is released.

In order to open the repeating unit after a shot, the grasp on the pistol grip 2 is simply loosened, whereby the press button 7 comes into its rest position. As a result, the blocking catch 9 is drawn downwards and can pass the blocking pin 11. At the same time, the safety catch 13 swings back so that the safety plate 15 blocks the trigger 5 again. The repeating unit can now be drawn back without the marksman having to take his hand off the pistol grip 2.

If, on account of maloperation, the breech mechanism 1 should not be completely closed, that is, the catch 9 is not engaged behind the blocking pin 12, the safety catch 13 is still at a sufficient distance from the safety plate 15 and cannot displace the latter. A release of the safety of the gun in this unlocked position is therefore precluded.

The invention is not limited, in every detail, to the exemplary embodiment which is represented. In particular, the operation of the locking mechanism of the repeating unit can also be effected by differently configured and differently actuated mechanisms. This applies in a similar manner to the release of the safety of the trigger 5 by way of the safety plate 15.

The repeating gun in accordance with the invention is equally suitable for hunters, sporting shooters and marksmen. Because the trigger does not form part of the repeating unit, but is fixedly articulated on the gun in relation to a trigger take-up screw 17, simplification in terms of manufacturing engineering and operation which is less susceptible to faults result.

We claim:

1. A repeating rifle comprising a breech mechanism and an actuating arrangement, the breech mechanism and the actuating arrangement being axially movable relative to a trigger and a breach bearing, between a first position and a second position for opening and closing a cartridge chamber, the breech mechanism being engaged with the breech bearing in the first position and the breech mechanism being disengaged with the breech bearing in the second position;

the actuating arrangement comprises a rifle grip including a safety device and a trigger guard;

the actuating arrangement being connected to the breech mechanism;

the safety device includes locking means for locking the breech mechanism in the first position and unlocking the breech mechanism when in the second position.

2. The repeating rifle according to claim 1, wherein the connection between the actuating arrangement and the breech mechanism comprises an L-shaped strip having a long portion and a short portion and wherein the long portion is connected to the rifle grip and the trigger guard and wherein the short portion is connected to the breech mechanism.

3. The repeating rifle according to claim 1, wherein the safety device comprises a spring actuated push button operatively connected to an assembly including a pivotable blocking catch and a corresponding spring loaded blocking pin, the spring actuated push button provides for a first position corresponding to a rest position of the pivotable blocking catch and for a second position corresponding to a locked position in which the pivotable blocking catch is blocked by the blocking pin.

4. The repeating rifle according to claim 3, wherein the safety device further comprises a spring actuated safety plate operatively connected with a pivotable safety catch, the safety catch is actuated when the breech mechanism and the actuating arrangement are in the second position.

* * * * *